US007306169B2

(12) United States Patent
Matsumura

(10) Patent No.: US 7,306,169 B2
(45) Date of Patent: Dec. 11, 2007

(54) FUEL INJECTION VALVE FOR INTERNAL COMBUSTION ENGINE

(75) Inventor: Eriko Matsumura, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 266 days.

(21) Appl. No.: 11/136,498

(22) Filed: May 25, 2005

(65) Prior Publication Data

US 2005/0284968 A1 Dec. 29, 2005

(30) Foreign Application Priority Data

Jun. 23, 2004 (JP) ..... 2004-185231

(51) Int. Cl.

| | |
|---|---|
| ***F02M 47/02*** | (2006.01) |
| ***F02M 59/00*** | (2006.01) |
| ***F02M 61/00*** | (2006.01) |
| ***B05B 1/30*** | (2006.01) |

(52) U.S. Cl. ..... 239/88; 239/89; 239/533.2; 239/533.12; 239/585.1; 239/585.3; 239/585.4; 239/585.5

(58) Field of Classification Search ..... 239/88, 239/89, 91, 95, 533.2, 533.3, 533.12, 585.1, 239/585.3, 585.4, 585.5; 251/129.15, 129.21, 251/127

See application file for complete search history.

(56) References Cited

U.S. PATENT DOCUMENTS

| | | | | |
|---|---|---|---|---|
| 4,153,205 | A * | 5/1979 | Parrish, Jr. | 239/533.9 |
| 4,528,951 | A * | 7/1985 | Yamada | 123/300 |
| 5,033,679 | A * | 7/1991 | Golev et al. | 239/533.3 |
| 5,890,660 | A * | 4/1999 | Stevens | 239/533.3 |
| 6,328,232 | B1 * | 12/2001 | Haltiner et al. | 239/585.1 |

FOREIGN PATENT DOCUMENTS

| | | |
|---|---|---|
| DE | 30 14 958 A1 | 10/1981 |
| DE | 36 05 082 A1 | 8/1987 |
| DE | 37 40 283 A1 | 6/1989 |
| DE | 196 05 368 A1 | 8/1997 |
| EP | 0 345 348 A1 | 12/1989 |
| EP | 1 180 596 A1 | 2/2002 |
| GB | 2 186 632 A | 8/1987 |
| JP | A 2002-147317 | 5/2002 |

* cited by examiner

*Primary Examiner*—Davis D. Hwu
(74) *Attorney, Agent, or Firm*—Oliff & Berridge, PLC

(57) ABSTRACT

A needle valve 20 having a seat contact section 24 at a leading end is provided. A nozzle body 22 having a seat section 26 with which the seat contact section 24 comes into contact is provided. The nozzle body 22 comprises a tapered surface 34, which includes the seat section 26, and a fuel receiver section 28, which includes a spherically shaped sack wall surface 36. The leading end of the needle valve 20 comprises a first protrusion 38, which is tapered to have a greater taper angle than the tapered surface 34, and a second protrusion 40, which is tapered to have a smaller taper angle than the first protrusion 38. More specifically, the second protrusion 40 is conically shaped.

4 Claims, 3 Drawing Sheets

FUEL INJECTION VALVE FOR INTERNAL COMBUSTION ENGINE

BACKGROUND OF THE INVENTION

1. Field of the Invention

The present invention relates to a fuel injection valve for an internal combustion engine, and more particularly to a fuel injection valve suitable for use in a direct-injection internal combustion engine, which injects fuel directly into a cylinder.

2. Background Art

A fuel injection valve for opening/closing a flow path by operating a needle valve is disclosed, for instance, by Japanese Patent Laid-Open No. 147317/2002. This fuel injection valve is such that the diameter of a flow path positioned downstream of a seat section with which the needle valve comes into contact is increased by tapering. Deposits in the flow path positioned downstream of a seat section decrease the cross-sectional area of the flow path, thereby reducing the fuel injection amount. The above conventional fuel injection valve is configured as described above to increase the amount of fuel flow on the downstream side of the seat section, thereby enhancing the effect of removing carbon deposits in the flow path positioned downstream of the seat section.

In fuel injection valves for an internal combustion engine, the amount of deposits increases when the capacity of the flow path positioned downstream of the seat section increases to increase the amount of fuel remaining in the flow path. According to a method employed by the above conventional fuel injection valve, the flow of fuel on the downstream side of the seat section can be improved; however, it is difficult to effectively avoid the accumulation of deposits. The reason is that the capacity of the flow path on the downstream side of the seat section is increased. Further, if the capacity of the flow path on the downstream side of the seat section is increased naively as in the case of the above conventional fuel injection valve, the spray characteristic might be impaired.

SUMMARY OF THE INVENTION

The present invention has been made to solve the above problems. It is an object of the present invention to provide a fuel injection valve for an internal combustion engine that is capable of controlling the accumulation of deposits in the flow path on the downstream side of the seat section with increased effectiveness for the purpose of avoiding a decrease in the fuel injection amount.

The above object is achieved by a fuel injection valve for an internal combustion engine which includes a needle valve having a seat contact section at a leading end of the needle valve. A nozzle body that includes a tapered surface having a seat section with which the seat contact section comes into contact and a predetermined area that is provided downstream of the seat section, and a fuel receiver section, which is formed by a sack wall surface that is positioned downstream of the tapered surface is provided. The leading end of the needle valve includes a first protrusion that is adjacent downstream to the seat contact section and tapered to have a greater taper angle than the tapered surface. And the leading end of the needle valve includes a second protrusion that protrudes downstream from the first protrusion and is formed so that the outermost protrusion end is positioned downstream of the intersection of the axis line of the needle valve and a virtual plane that is extended from an inclined surface of the first protrusion.

Other objects and further features of the present invention will be apparent from the following detailed description when read in conjunction with the accompanying drawings.

BEST MODE OF CARRYING OUT THE INVENTION

First Embodiment

Figure 1:
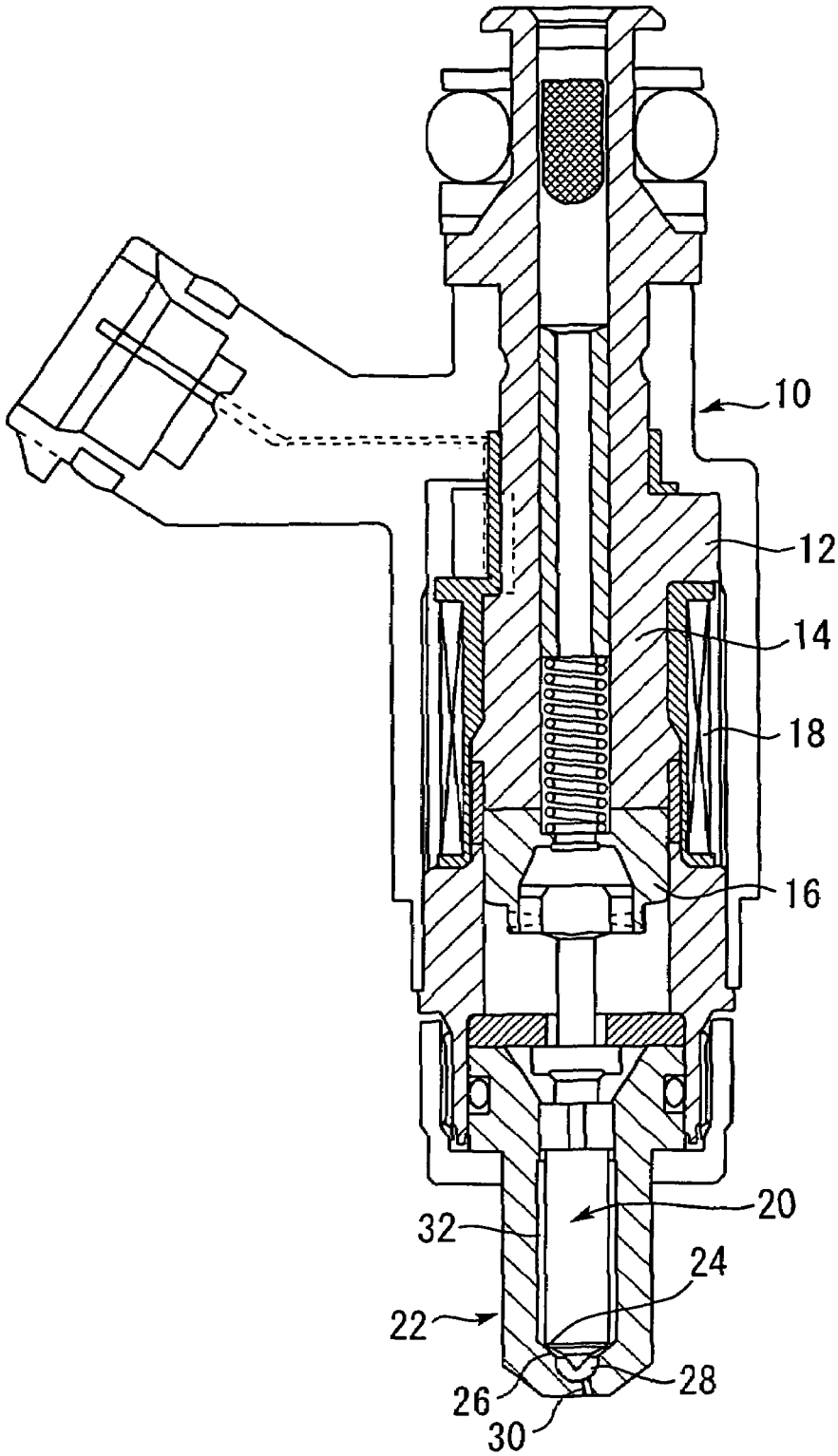
FIG. 1 is a vertical cross-sectional view illustrating a first embodiment of a fuel injection valve according to the present invention.

FIG. 1 is a vertical cross-sectional view illustrating a first embodiment of a fuel injection valve 10 according to the present invention. The fuel injection valve 10 shown in FIG. 1 is suitable for use, for instance, in a direct-injection gasoline engine, which injects fuel directly into a cylinder. However, the fuel injection valve according to the present invention is not limited for use in a direct-injection gasoline engine.

The fuel injection valve 10 according to the present embodiment includes a stationary core 12, which is made of a magnetic material. A movable core 16 is positioned next to the stationary core 12 and pressed downward by a coil spring 14. The movable core 16 can slide the interior of the fuel injection value 10 in its axial direction. The circumference of the stationary core 12 is provided with an electromagnetic coil 18. The fuel injection valve 10 is configured so that the movable core 16 is attracted by the stationary core 12 when the electromagnetic coil 18 generates a predetermined magnetic force, and that the coil spring 14 operates to separate the movable core 16 from the stationary core 12 when the magnetic force disappears.

The movable core 16 is coupled to a needle valve 20, which coordinates with the movable core 16 to displace the interior of the fuel injection valve 10. The fuel injection valve 10 includes a nozzle body 22, which is formed to surround the needle valve 20. The nozzle body 22 includes a seat section 26 with which a seat contact section 24 of the needle valve 20 comes into contact, a fuel receiver section (sack) 28, which is positioned to face the needle valve 20, and a nozzle hole 30, which communicates with the fuel receiver section 28.

As shown in FIG. 1, a space 32 is formed between the needle valve 20 and the nozzle body 22. Pressurized fuel is supplied from a fuel source (not shown) to this space 32. While no exciting current is supplied to the electromagnetic coil 18, the needle valve 20 is seated in the seat section 26 of the nozzle body 22 to block up the nozzle hole 30. In this instance, no fuel is injected from the nozzle hole 30.

When an exciting current is supplied to the electromagnetic coil 18 in the above state, the movable core 16 is attracted by the stationary core 12 so that the needle valve 20 leaves the seat section 26. As a result, the pressurized fuel, which is stored around the needle valve 20, flows into the fuel receiver section 28. The fuel is then emitted outward from the nozzle hole 30.

When carbon deposits are accumulated in the flow path on the downstream side of the seat section 26 within the fuel injection valve 10, which is configured as described above, the fuel injection amount decreases due to a decrease in the flow path cross-sectional area. When the capacity of the fuel receiver section 28 is decreased, the fuel injection valve 10 according to the present embodiment, which includes the fuel receiver section 28, can decrease the amount of fuel remaining in the fuel receiver section 28, thereby controlling the accumulation of deposits. However, when the capacity of the fuel receiver section 28 is naively decreased, it is difficult to obtain a desired spray characteristic (spray shape, etc.). For a direct-injection internal combustion engine, it is particularly important that a good spray characteristic be obtained. To obtain a good spray characteristic, the wall surface shape of the fuel receiver section 28 should not be merely changed for the purpose of reducing the amount of deposits. Under these circumstances, the fuel injection valve 10 according to the present embodiment is configured as described below to meet the above requirements. More specifically, the fuel injection valve 10, which includes the fuel receiver section 28, is configured as described below to prevent the fuel injection amount from being decreased by the accumulation of deposits without impairing the spray characteristic. In this specification, based on the direction of fuel flow within the fuel injection valve 10, a nozzle hole 30 side to the seat section 26 side is called "a downstream side of the seat section 26" or simply "a downstream side".

The structure of the nozzle body section, which is peculiar to the fuel injection valve 10 according to the present embodiment, will now be described in detail with reference to FIG. 2.

Figure 2:
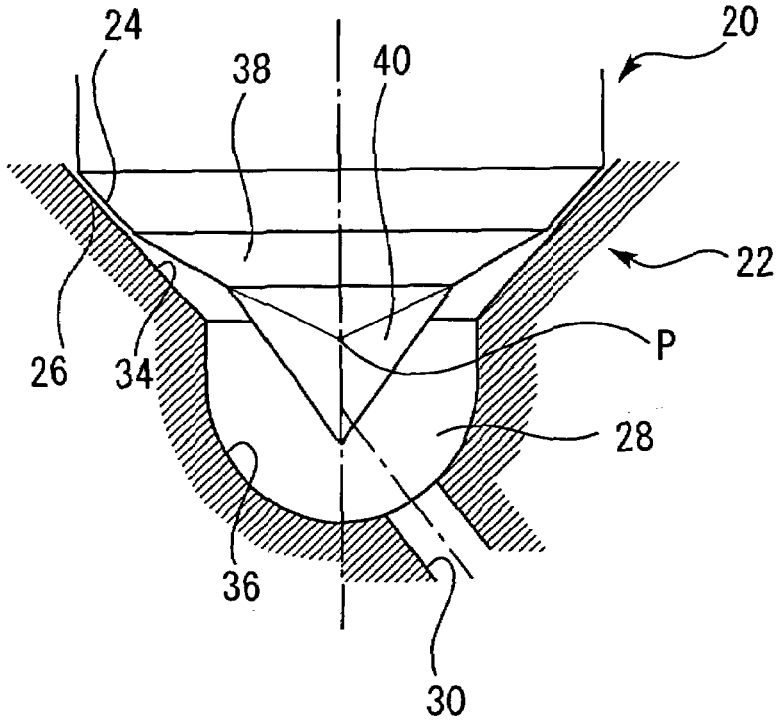
FIG. 2 is an enlarged vertical cross-sectional view illustrating the nozzle body section of the fuel injection valve shown in FIG. 1.

FIG. 2 is an enlarged vertical cross-sectional view illustrating the nozzle body section of the fuel injection valve 10 shown in FIG. 1. As shown in FIG. 2, the nozzle body 22 has a tapered surface 34, which includes the seat section 26. The tapered surface 34 has a predetermined area that is provided downstream of the seat section 26. A sack wall surface 36 is formed on the downstream side of the tapered surface 34. To provide a good spray characteristic, the sack wall surface 36 includes a spherical surface that faces the needle valve 20. The aforementioned fuel receiver section 28 is a space that is formed by the sack wall surface 36. The aforementioned nozzle hole 30 is provided in the sack wall surface 36, cylindrically shaped, and centered with respect to an axis line that is inclined at a predetermined angle from the axis line of the needle valve 20.

The leading end of the needle valve 20 is provided with a first protrusion 38 and a second protrusion 40, which are positioned downstream of the seat contact section 24. The first protrusion 38 is tapered to have a greater taper angle than the tapered surface 34. The second protrusion 40 protrudes downstream from the first protrusion 38 and is formed so that the outermost protrusion end is positioned downstream of the intersection P of the axis line of the needle valve 20 and a virtual plane that is extended from an inclined surface of the first protrusion 38. More specifically, the second protrusion 40 is tapered to have a smaller taper angle than the first protrusion 38. To meet the above shape requirements, the second protrusion 40 according to the present embodiment is conically shaped to protrude downstream from the first protrusion 38. As described above, the needle valve 20 according to the present embodiment has a two-step tapered protrusion that involves two different taper angles and is positioned downstream of the seat contact section 24.

As described above, the fuel injection valve 10 according to the present embodiment includes the first protrusion 38, which has a greater taper angle than the tapered surface 34. Therefore, the flow path adjacent downstream to the seat section 26 has a large flow path cross-sectional area. Therefore, it is possible to prevent the fuel injection amount from being decreased by the accumulation of deposits. Further, the capacity of the fuel receiver section 28 is decreased because the second protrusion 40, which protrudes downstream from the first protrusion 38, is provided. As a result, the amount of fuel remaining in the fuel receiver section 28 can be decreased to reduce the amount of deposits in the fuel receiver section 28.

Further, the fuel injection valve 10 according to the present embodiment is configured so that the second protrusion 40 is tapered to have a smaller taper angle than the first protrusion 38. In addition, the leading end of the second protrusion 40 is conically shaped to have an acute angle. Therefore, the flow of fuel from the seat section 26 to the fuel receiver section 28 is improved. More specifically, since the leading end of the needle valve 20 has a two-step tapered surface as described above, a whirlpool generated within the fuel receiver section 28 is reduced to a small scale. Consequently, the fuel steadily flows without being separated from the surface of the needle valve 20. In other words, the force of removing deposits from the surface of the needle valve 20 is increased. In addition, the surface temperature of the needle valve 20 decreases. As a result, it is possible to effectively control the accumulation of deposits in the needle valve 20. Moreover, the spray characteristic remains unimpaired because the sack wall surface 36 is spherical.

As described above, the fuel injection valve 10 according to the present embodiment effectively controls the accumulation of deposits in the flow path on the downstream side of the seat section 26 (the leading end of the needle valve 20 and the tapered surface 34) without impairing the spray characteristic, thereby controlling the decrease in the fuel injection amount. In addition, the fuel injection valve 10 according to the present embodiment provides the above advantage without changing the shape of the fuel receiver section 28, which is important for spray characteristic determination.

Second Embodiment

A second embodiment of the present invention will now be described with reference to FIG. 3.

Figure 3:
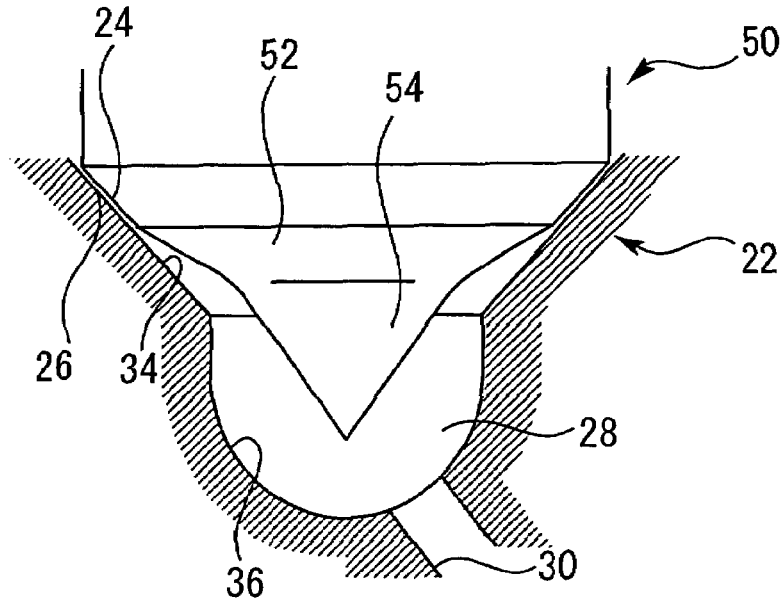
FIG. 3 is a vertical cross-sectional view illustrating the leading end shape of the needle valve that is used in the second embodiment of the present invention.

FIG. 3 is a vertical cross-sectional view illustrating the leading end shape of the needle valve 50 that is used in the second embodiment of the present invention. As indicated in FIG. 3, the leading end of the needle valve 50 according to the present embodiment is configured the same as in the first embodiment except that the vertical cross-section of a joint between the first protrusion 52 and second protrusion 54 is curved, or more specifically, shaped like an arc. According to the configuration shown in FIG. 3, the fuel flowing into the fuel receiver section 28 flows along the leading end of the needle valve 50 more steadily with the degree, for instance, of separation control enhanced than in the configuration of the first embodiment.

In the foregoing first or second embodiment, the fuel injection valve 10 with the needle valve 20 shown in FIG. 2 or the fuel injection valve with the needle valve 50 shown in FIG. 3 can effectively control the accumulation of deposits without impairing the spray characteristic as described above. According to the needle valve 20 or 50, which is configured as described above, the spray characteristic can be changed by adjusting the leading end shape of the needle valve. For example, the spray penetration force (index for indicating the spray's reachable distance) can be reduced by increasing the taper angle of the second protrusion 40 for the needle valve 20 shown in FIG. 2 or by decreasing the arc curvature of the joint between the first protrusion 52 and second protrusion 54 for the needle valve 50 shown in FIG. 3. Further, the spray particle size can be reduced by ensuring that the taper angle of the second protrusion 40 or 54 is two times the injection angle of the nozzle hole 30 (the angle between the axis line of the needle valve 20 or 50 and the axis line of the nozzle hole 30). When the method described above is used, it is possible to adjust the spray characteristic by changing the shape of the leading end of the needle valve 20 or 50. Therefore, when various spray characteristics are demanded depending on the internal combustion engine specifications, the specifications can be complied with by changing the leading end shape of the needle valve.

Third Embodiment

A third embodiment of the present invention will now be described with reference to FIG. 4.

Figure 4:
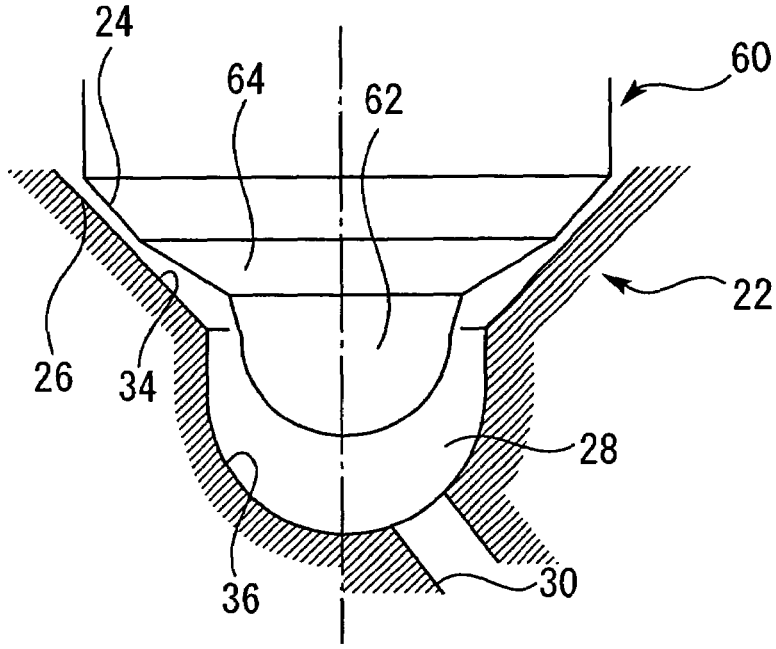
FIG. 4 is a vertical cross-sectional view illustrating the leading end shape of the needle valve that is used in the third embodiment of the present invention.

FIG. 4 is a vertical cross-sectional view illustrating the leading end shape of the needle valve 60 for use in the third embodiment of the present invention. As indicated in FIG. 4, the leading end of the needle valve 60 according to the present embodiment is configured the same as in the first embodiment except that the leading end of the second protrusion 62 is spherically shaped. More specifically, the configuration shown in FIG. 4 is such that the difference between the taper angle of the first protrusion 64 and the taper angle of the second protrusion 62 is greater than in the configuration of the first embodiment. Further, the configuration shown in FIG. 4 is such that the size of the leading end of the second protrusion 62 is significantly decreased in a direction toward the axis line. When this configuration is employed, the resulting leading end shape of the needle valve with a two-step protrusion at the leading end (due to the use of different taper angles) is such that the capacity of the fuel receiver section 28 can be effectively reduced. Consequently, the needle valve 60 according to the present embodiment can effectively control the accumulation of deposits by reducing the amount of fuel remaining in the fuel receiver section 28.

Fourth Embodiment

A fourth embodiment of the present invention will now be described with reference to FIG. 5.

Figure 5:
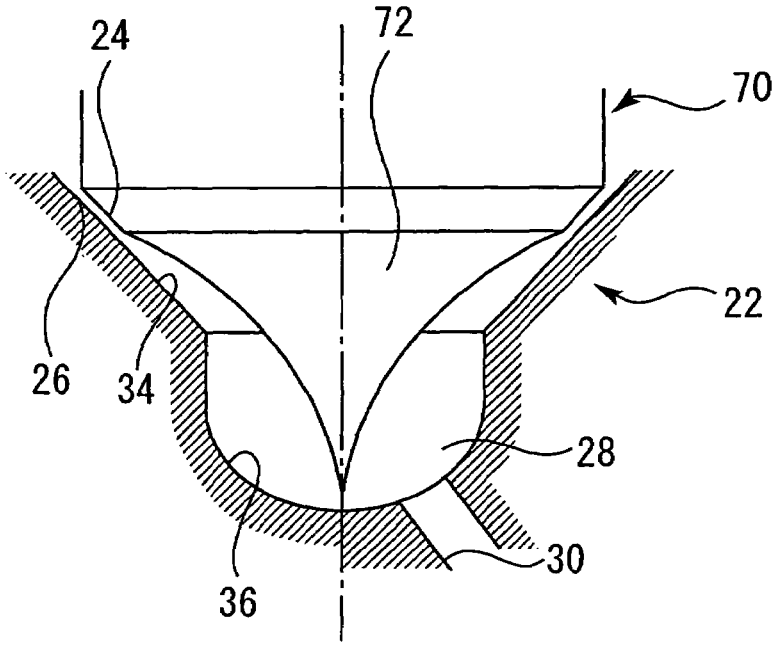
FIG. 5 is a vertical cross-sectional view illustrating the leading end shape of the needle valve that is used in the fourth embodiment of the present invention.

FIG. 5 is a vertical cross-sectional view illustrating the leading end shape of the needle valve 70 for use in the fourth embodiment of the present invention. As indicated in FIG. 5, the leading end of the needle valve 70 according to the present embodiment is configured the same as in the first embodiment except that the protrusion 72 provided downstream of the seat contact section 24 has a curved surface that is formed convexly toward the axis line of the needle valve 70. When the configuration is as indicated in FIG. 5, the cross-sectional area of a flow path between the base of the protrusion 72 and the tapered surface 34 is increased. Further, the capacity of the fuel receiver section 28 is decreased because the protrusion 72 protrudes into the fuel receiver section 28. In addition, the protrusion 72 has a continuous curved surface. Therefore, the fuel flowing into the fuel receiver section 28 flows along the leading end of the needle valve 70 more steadily with the degree, for instance, of separation control enhanced than in the configuration of the second embodiment.

The major features and benefits of the present invention described above are summarized as follows:

The first aspect of the present invention includes a fuel injection valve for an internal combustion engine which includes a needle valve having a seat contact section at a leading end of the needle valve. A nozzle body that includes a tapered surface having a seat section with which the seat contact section comes into contact and a predetermined area that is provided downstream of the seat section, and a fuel receiver section, which is formed by a sack wall surface that is positioned downstream of the tapered surface is provided. The leading end of the needle valve includes a first protrusion that is adjacent downstream to the seat contact section and tapered to have a greater taper angle than the tapered surface. And the leading end of the needle valve includes a second protrusion that protrudes downstream from the first protrusion and is formed so that the outermost protrusion end is positioned downstream of the intersection of the axis line of the needle valve and a virtual plane that is extended from an inclined surface of the first protrusion.

The second aspect of the present invention, the second protrusion may be tapered to have a smaller taper angle than the first protrusion.

The third aspect of the present invention, the second protrusion may be conically shaped.

The fourth aspect of the present invention, the leading end of the second protrusion may be spherically shaped.

The fifth aspect of the present invention, the vertical cross-section of a joint between the first protrusion and the second protrusion may be curved.

The sixth aspect of the present invention includes a fuel injection valve for an internal combustion engine which includes a needle valve having a seat contact section at a leading end of the needle valve. A nozzle body that includes a tapered surface having a seat section with which the seat contact section comes into contact and a predetermined area that is provided downstream of the seat section, and a fuel receiver section, which is formed by a sack wall surface that is positioned downstream of the tapered surface is provided. The leading end of the needle valve includes a protrusion that is adjacent downstream to the seat contact section and curved convexly toward the axis line of the needle valve.

The seventh or eighth aspect of the present invention, the sack wall surface may include a spherical surface that faces the leading end of the needle valve.

According to the first aspect of the present invention, the cross-sectional area of the downstream flow path adjacent to the seat section can be increased. Therefore, it is possible to control the decrease in the fuel injection amount, which may be caused by deposits. Further, the second protrusion is provided to reduce the capacity of the fuel receiver section. Therefore, it is possible to reduce the amount of deposits in the fuel receiver section. As a result, the present aspect of the invention makes it possible to effectively control the accumulation of deposits in the flow path on the downstream side of the seat section, thereby controlling the decrease in the fuel injection amount.

According to the second aspect of the present invention, the flow of fuel in the leading end section of the needle valve can be improved. The force of removing deposits from the surface of the needle valve is then increased. Consequently, the surface temperature of the needle valve decreases. As a result, it is possible to effectively control the accumulation of deposits in the needle valve.

According to the third aspect of the present invention, the leading end of the needle valve can be shaped so as to improve the flow of fuel in the needle valve section, thereby effectively controlling the accumulation of deposits.

According to the fourth aspect of the present invention, the leading end can be shaped to reduce the capacity of the fuel receiver section with increased effectiveness. As a result, the present aspect of the invention makes it possible to reduce the amount of fuel remaining in the fuel receiver section, thereby effectively controlling the accumulation of deposits.

According to the fifth aspect of the present invention improves the flow of fuel in the need valve section to a greater extent than the second to fourth aspects of the present invention.

According to the sixth aspect of the present invention, the cross-sectional area of a flow path between the base of the protrusion and the tapered surface is increased. Further, the capacity of the fuel receiver section is decreased because the protrusion in the leading end section protrudes into the fuel receiver section. As a result, the present aspect of the invention makes it possible to effectively control the accumulation of deposits in the flow path on the downstream side of the seat section, thereby controlling the decrease in the fuel injection amount. In addition, the sixth aspect of the present invention improves the flow of fuel in the needle valve section to a greater extent than the aforementioned fifth aspect of the present invention.

According to the seventh or eighth aspect of the present invention, the fuel receiver section can be properly shaped to provide a good spray characteristic. As a result, the present aspect of the invention makes it possible to effectively control the accumulation of deposits in the flow path on the downstream side of the seat section without impairing the spray characteristic, thereby controlling the decrease in the fuel injection amount.

Further, the present invention is not limited to these embodiments, but variations and modifications may be made without departing from the scope of the present invention.

The invention claimed is:

1. A fuel injection valve for an internal combustion engine comprising:

a needle valve having a seat contact section at a leading end of the needle valve; and a nozzle body that includes a tapered surface having a seat section with which said seat contact section comes into contact and a predetermined area that is provided downstream of said seat section, and a fuel receiver section, which is formed by a sack wall surface that is positioned downstream of said tapered surface;

wherein said leading end of said needle valve includes a first protrusion that is adjacent downstream to said seat contact section and tapered to have a greater taper angle than said tapered surface; and a second protrusion that protrudes downstream from said first protrusion and is formed so that the outermost protrusion end is positioned downstream of the intersection of the axis line of said needle valve and a virtual plane that is extended from an inclined surface of said first protrusion;

wherein said second protrusion is tapered to have a smaller taper angle than said first protrusion; and wherein the vertical cross-section of a joint between said first protrusion and said second protrusion is curved.

2. A fuel injection valve for an internal combustion engine according to claim 1, wherein said second protrusion is conically shaped.

3. A fuel injection valve for an internal combustion engine according to claim 1, wherein said leading end of said second protrusion is spherically shaped.

4. A fuel injection valve for an internal combustion engine according to claim 1, wherein said sack wall surface includes a spherical surface that faces the leading end of said needle valve.

* * * * *